US006186683B1

(12) United States Patent
Shibuki

(10) Patent No.: US 6,186,683 B1
(45) **Date of Patent: *Feb. 13, 2001**

(54) RECORDING APPARATUS

(75) Inventor: Takashi Shibuki, Chiba (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/131,546

(22) Filed: Aug. 10, 1998

(30) Foreign Application Priority Data

Aug. 11, 1997 (JP) ..... 9-216473

(51) Int. Cl.[7] ..... B41J 2/315

(52) U.S. Cl. ..... 400/120.08; 400/120.15; 347/185; 347/195

(58) Field of Search ..... 400/120.08, 120.15, 400/120.09; 347/185, 186, 195

(56) References Cited

U.S. PATENT DOCUMENTS 4,284,876 * 8/1981 Ishibashi et al. ..... 347/195
4,432,001 * 2/1984 Inui et al. ..... 346/76
4,514,738 * 4/1985 Nagato et al. ..... 347/195
4,590,487 * 5/1986 Noguchi et al. ..... 347/196
5,021,805 * 6/1991 Imaizumi et al. ..... 400/120.08 X
5,025,267 * 6/1991 Schofield et al. ..... 347/186 X
5,066,961 * 11/1991 Yamashita ..... 347/195 X
5,132,703 * 7/1992 Nakayama ..... 400/120.15 X
5,268,706 * 12/1993 Sakamoto ..... 347/195 X

FOREIGN PATENT DOCUMENTS 63-173669 7/1988 (JP) .

* cited by examiner

*Primary Examiner*—John S. Hilten
*Assistant Examiner*—Minh Chau
(74) *Attorney, Agent, or Firm*—Sidley & Austin

(57) ABSTRACT

In a heat transfer recording apparatus for printing images on recording paper by bringing ink film in contact with recording paper and heating them by means of a thermal head, the preheating time of the thermal head is decided based on the thermal head temperature detected by a thermistor and the accumulated power supply time obtained as a product of the number of times power is supplied to the thermal head and the detection interval, thus to achieve a uniform image quality by eliminating the effect of the thermal head heat accumulation even in case of forming multiple images successively on multiple sheets of recording paper.

19 Claims, 11 Drawing Sheets

| THERMISTOR DETECTION TEMPERATURE (T) / ACCUMULATED POWER SUPPLY TIME (t) | $T_1$ | $T_2$ | $T_3$ | ••• | $T_n$ |
|---|---|---|---|---|---|
| 0 | $\tau_{01}$ | $\tau_{02}$ | $\tau_{03}$ | ••• | $\tau_{0n}$ |
| $0 < t \leqq t_1$ | $\tau_{11}$ | $\tau_{12}$ | $\tau_{13}$ | ••• | $\tau_{1n}$ |
| $t_1 < t \leqq t_2$ | $\tau_{21}$ | $\tau_{22}$ | $\tau_{23}$ | ••• | $\tau_{2n}$ |
| •<br>•<br>• | •<br>•<br>• | •<br>•<br>• | •<br>•<br>• | •••<br>•••<br>••• | •<br>•<br>• |
| $t_{(m-1)} < t \leqq t_m$ | $\tau_{m1}$ | $\tau_{m2}$ | $\tau_{m3}$ | ••• | $\tau_{mn}$ |

PREHEAT TIME BASED ON THERMISTOR DETECTION TEMPERATURE AND ACCUMULATED POWER SUPPLY TIME
PREHEAT TIME BASED ON THERMISTOR DETECTION TEMPERATURE

ON
OFF
1ST PRINT
PREHEAT
PRINT
PREHEAT
PRINT

ON
OFF
2ND PRINT

ON
OFF
3RD PRINT

ON
OFF
4TH PRINT

RECORDING APPARATUS

BACKGROUND OF THE INVENTION

1. Field of the Invention

The present invention relates to a recording apparatus, in particular, to a heat transfer recording apparatus using an ink film.

2. Description of the Related Art

A heat transfer recording apparatus such as a printer comprises a platen roller and a thermal head that can be arbitrarily pressed against the platen roller. The recording paper is transferred together with the ink film between the platen roller and the thermal head to allow characters and/or graphic images printed thereon. The ink film has thermally fusing or sublimating type of inks coated on one side thereof. The ink is fused or sublimated to be fixed on the recording paper by means of the heat of the thermal head.

A heat transfer recording apparatus normally preheats its thermal head when forming images on recording paper. The preheating time of the thermal head customarily has been decided based on the temperature of the thermal head detected by means of a thermistor provided immediately above or near the thermal head. The thermistor is not directly detecting the actual thermal head temperature. As a result, when images are recorded on multiple sheets of recording paper successively, it causes a problem that the density of images recorded on recording paper earlier may not be the same as images recorded later because of the delayed response of the thermistor. The problem particularly comes into prominence in the case of half-tone images.

For example, if images are recorded on seven sheets of recording paper successively, the preheating time is set constant as there is no difference in the thermistor detection temperature. However, since the thermal head accumulates heat as time goes, the density of the images on the first to the third sheets are weaker relative to the images on the fourth to the seventh sheets.

SUMMARY OF THE INVENTION

The purpose of the invention is to provide a uniform image quality even when images are formed successively on multiple sheets of recording paper.

One aspect of the present invention is a recording apparatus for forming an image on a recording paper by heating an ink film, the recording apparatus comprising: a temperature detector that detects temperature of a heat source that heats ink films; an accumulated time detector that detects an accumulated time period during which electric power is supplied to the heat source within a prescribed period until up to image forming time; and a preheating time controller that decides a preheating time of the heat source based on a heat source temperature detected by said temperature detector and an accumulated power supply time detected by said accumulated time detector.

Another aspect of the present invention is a recording apparatus for forming an image on a recording paper by heating an ink film, said recording apparatus comprising: a heat source; a heat source controller which controls said heat source so as to generate heat for a prescribed time prior to printing for each recording paper and to generate heat during printing; and a time controller which decides said prescribed time based on a temperature of said heat source and sum of time period during which said heat source generates heat.

The objects, features, and characteristics of this invention other than those set: forth above will become apparent from the description given herein below with reference to preferred embodiments illustrated in the accompanying drawings.

DETAILED DESCRIPTION OF THE PREFERRED EMBODIMENT

The embodiments of this invention will be described below with reference to the accompanying drawings.

<Embodiment 1>

Figure 1:
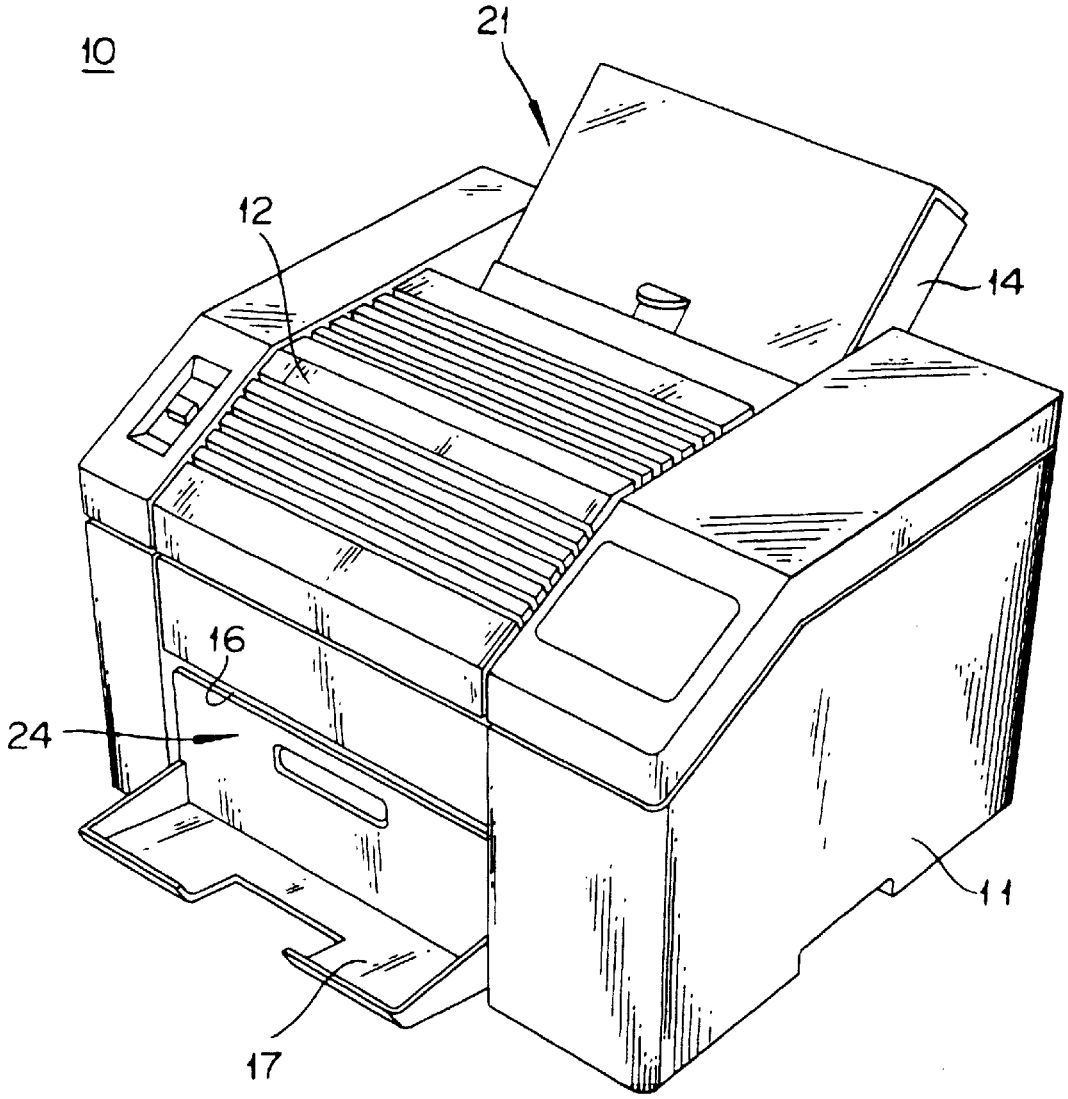
FIG. 1 is an external perspective view of a heat transfer recording apparatus according to the first embodiment of the present invention.

FIG. 1 is an external perspective view of a heat transfer recording apparatus according to an embodiment of the present invention. For the sake of convenience in the following description, the edge of the recording paper which leads the paper when it is being discharged will be called the leading edge.

The recording apparatus 10 is used, for example, in a photofinisher, where photographs are printed for the purpose of index printing or reproducing the information recorded on multiple frames of a negative film on a sheet of recording paper. A control device (not shown), which conducts various image processing to the image information read from a negative film, is connected to the recording apparatus 10 via an interface, so that image signals and control signals from the control device can be delivered. The recording apparatus 10 can also be connected to a computer to print the images prepared by the computer as well.

Figure 2:
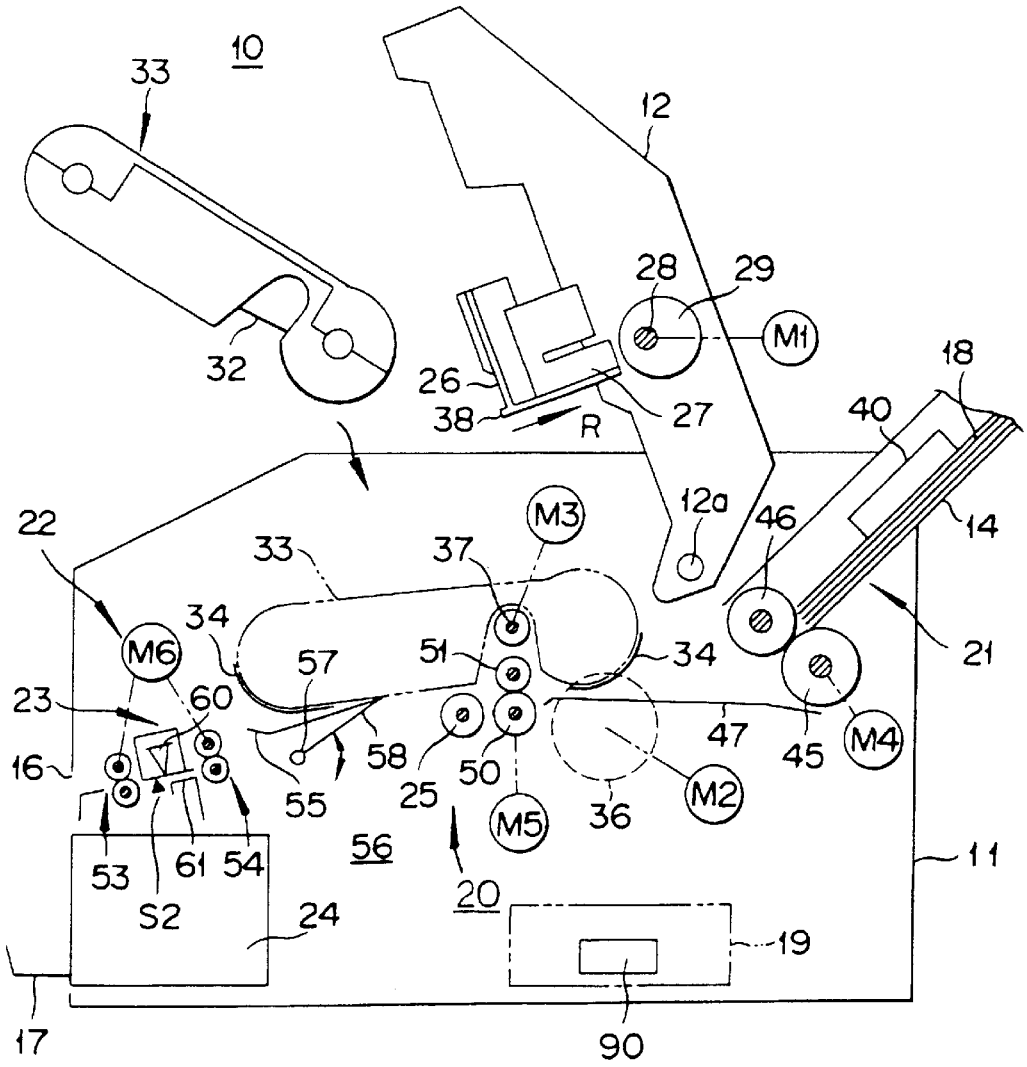
FIG. 2 is an outline cross section of the recording apparatus with its cover opened.

A housing 11 which constitutes the main body of the recording apparatus 10 has a cover 12 that can be opened around a swivel shaft 12*a* (FIG. 2). This enables the ink film cassette to be loaded into a desired position within the housing 11 when the cover 12 is opened. A paper discharge section is provided on the front end of the recording apparatus 10, while a paper feed unit 21 is provided on the back end. The front end of the apparatus 10 is on the left side of this drawing.

A paper supply tray 14 that stocks many sheets of paper is provided in the paper feed unit 21 in a tilted position. The recording apparatus 10 comprises also a cutting section to cut off useless portions (leading and/or trailing ends) of the recording paper after the image has been reproduced as well as a scrap reception unit 24 that stores paper scraps produced as a result of the cutting. The reception unit 24 is provided at the front end of the apparatus in a removable manner. The recording paper, whose useless portions have been cut off, is discharged through a discharge opening 16 in a vertical direction on a discharge tray 17 provided as an integral part of the front surface of the reception unit 24.

As mentioned before, the paper supply tray 14 is provided in a tilted position and the recording paper is discharged in a vertical direction. Therefore, the dimension that the discharge tray 17 protrudes from the front surface of the housing 11 is relatively small. Hence, the overall installation space requirement of the recording apparatus 10 is minimal, making it a unit suitable for installation in a narrow place.

The recording apparatus 10 uses an ink film coated with thermally sublimable inks as well as thick (150–250 $\mu$m) and sturdy recording paper such as photographic paper as the image receiving paper to trap the sublimated inks.

Figure 3:
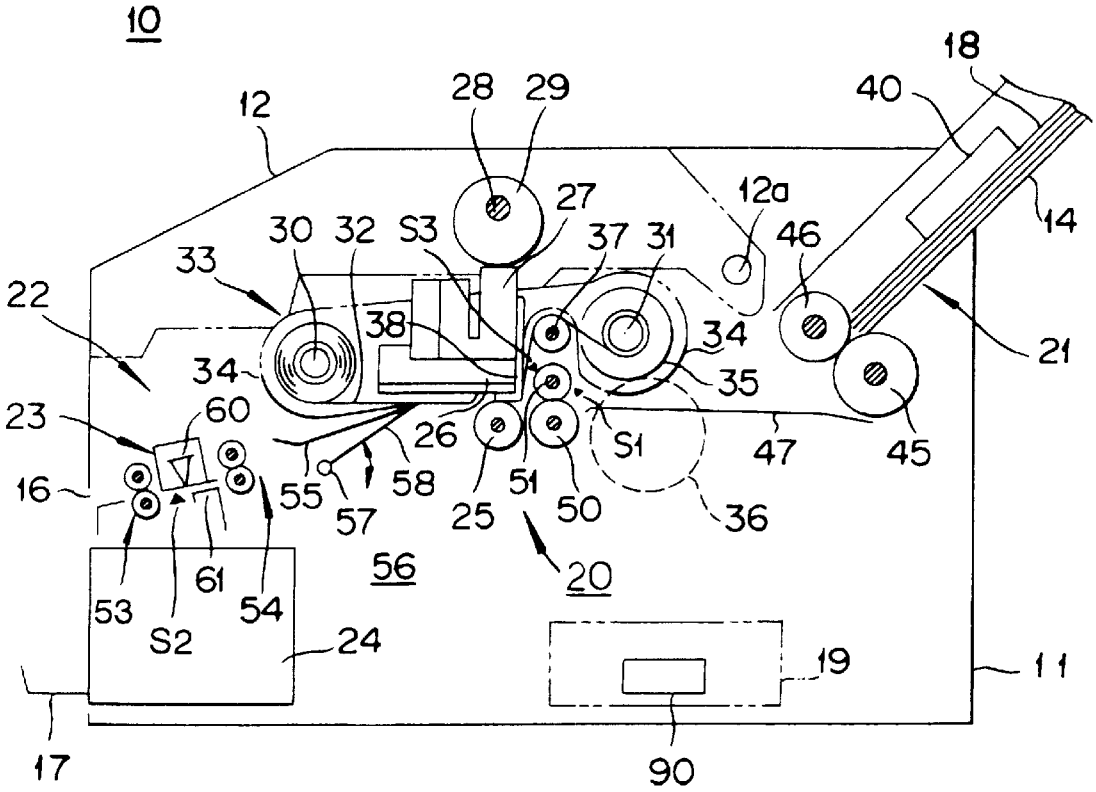
FIG. 3 is an outline cross section of the recording apparatus with a cassette loaded into its main body.
Figure 4A:
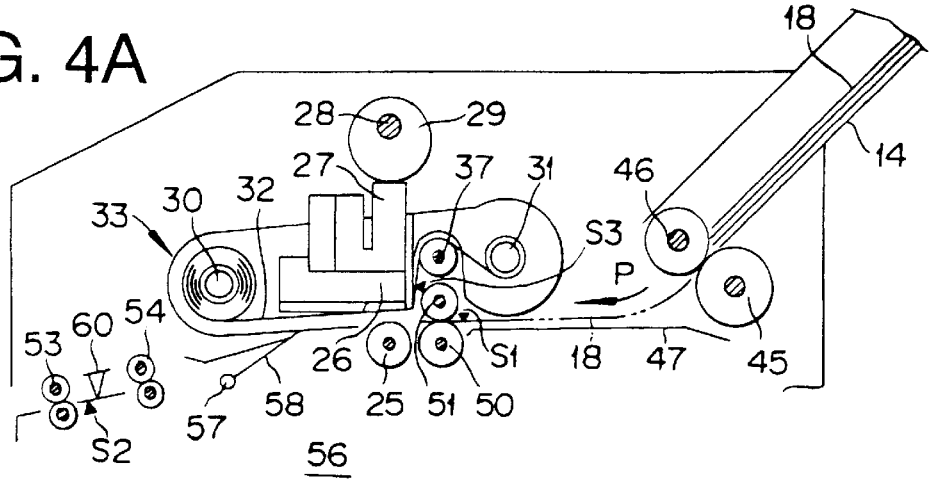
FIGS. 4A through 4C are the cross sections of the recording apparatus showing operations during paper feed, at the start of printing, and at the end of printing respectively.
Figure 4B:
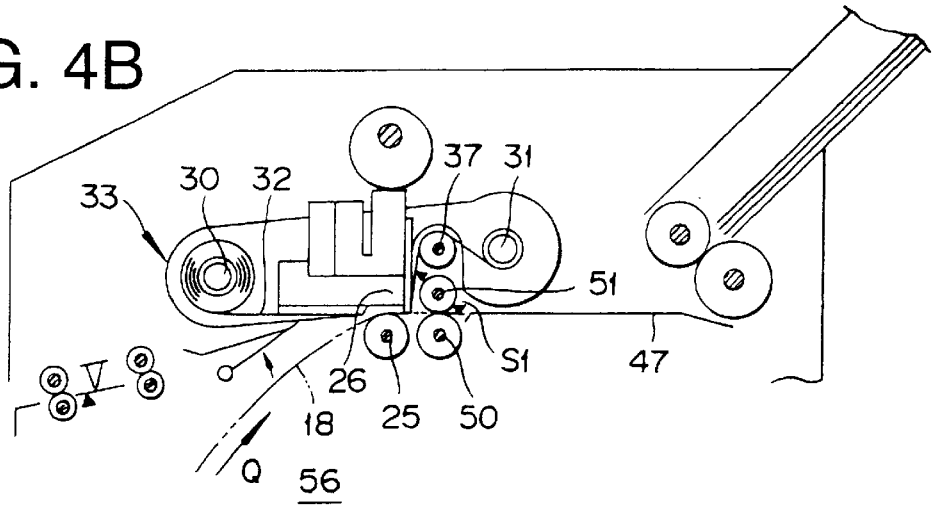
Figure 4C:
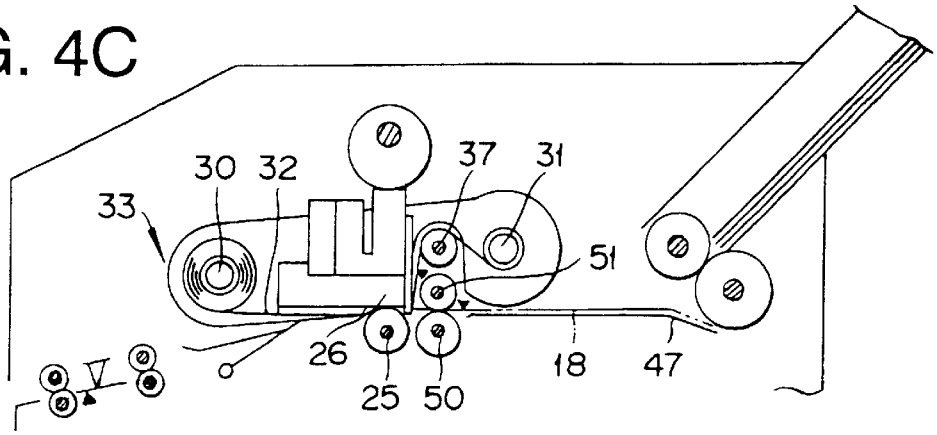

FIG. 2 is an outline cross section of the heat transfer recording apparatus with a cover opened. FIG. 3 is an outline cross section of the heat transfer recording apparatus with a cassette loaded into its main body. And FIGS. 4A through 4C are the cross sections of the heat transfer recording apparatus showing outlines of operations during paper feed, at the start of printing, and at the end of printing respectively.

Let us first describe the internal structure of the heat transfer recording apparatus 10.

As shown in FIG. 2 and FIG. 3, the heat transfer recording apparatus 10 comprises a print section 20, which is located approximately in the middle, the paper feed unit 21, which is located at the back upper end of the apparatus in a 45 degrees tilted position, and a paper discharge section 22, which is provided on the opposite side of the paper feed unit 21 across the print section 20. The print section 20 transfers recording paper 18 approximately straight in order to improve the print quality for thick and sturdy recording paper 18.

As mentioned before, the installation space requirement is minimized by providing the paper feed unit 21 in a tilted position. Moreover, since the paper discharge section 22 is provided on the opposite side of the paper feed unit 21 across the print section 20, the unit can be used in a manner similar to that of a facsimile machine, making it a more acceptable apparatus for users. The paper discharge section 22 is provided with the cutting section 23 that cuts off useless sections of the recording paper 18 after the image has been reproduced, and the reception unit 24 underneath it.

Let us now describe the internal structure of the heat transfer recording apparatus 10.

A platen roller 25 is rotatably held inside the housing 11. A head base 27 having a thermal head (heat source) 26 is provided inside the cover 12 in such a way as to make it movable relative to the platen roller 25 by means of a linking member not shown. When the head base 27 advances toward the platen roller 25, the thermal head 26 moves to a position to press against the platen roller 25. When the head base 27 moves away from the platen roller 25, the thermal head 26 moves to a position where it no longer presses against the latter. The head base 27 is constantly pushed by an urging force of a spring (not shown) in the direction of an arrow R shown in FIG. 2 to keep the thermal head 26 away from the platen roller 25 to a position where it does not press against the latter.

An eccentric cam 29 is fixed to a driving shaft 28, which is attached rotatably to the cover 12. The eccentric cam 29 is used to make contact with and move the head base 27 so that the thermal head 26 will be pressed against the platen roller 25. A thermal head driving motor M1 as a pulse motor is connected to the driving shaft 28 to rotate the eccentric cam 29 thus to move the thermal head 26.

As shown in FIG. 3, a ribbon-like ink film 32, which is supplied from a supply reel 30, is transferred between the thermal head 26 and the platen roller 25 to be taken up by a take-up reel 31. A base film of the ink film 32 is coated with three layers of inks, i.e., yellow, magenta, and cyan, as well as a top coat layer in that order side by side, repeatedly in a direction perpendicular to its lengthwise direction of the film. Incidentally, an ink film in four colors having black ink layer in addition to yellow, magenta, and cyan ink layers is applicable. The supply reel 30 and the take-up reel 31 are held in a cassette 33. Th e cassette 33 is loaded into the housing 11 in a removable manner by being set on a holding plate 34, which is attached to the housing 11. When the cassette is loaded, a gear 35 attached to the take-up reel 31 and partially exposed through an opening formed on the cassette 33 engages with a driver gear 36 provided on the apparatus side. The driving gear 36, which is driven by a motor M2, is used to take up the ink film 32 by means of the take-up reel 31.

A take-up roller 37 of the ink film is provided in the vicinity of the platen roller 25. The take-up roller 37 is used to form a transfer route for the ink film 32 when the cassette is loaded. The take-up roller 37 is normally free-wheeling but becomes capable of being driven by the ink film take-up motor M3 when a clutch (not shown) is connected, thus to move the in k film 32, when the apparatus is not printing. When it is printing, however, the ink film 32 is fed out in coordination with the transfer of the recording paper 18, guided by a guide plate 38 attached to the edge of the thermal head 26 and the take-up roller 37, which is now free-wheeling, and taken-up by the take-up reel 31.

The paper supply tray 14 has width regulating plates 40 to regulate the width direction of the recording paper 18 held in the paper supply tray 14 in a tilted position. The width regulating plates 40 are freely adjustable widthwise according to the size of the recording paper 18.

The recording paper 18 held in the paper supply tray 14 is supplied one sheet at a time with the help of a paper feed roller 45 and a paper guide roller 46, which is placed facing the paper feed roller 45 across a tiny gap, and transferred, guided by a guide 47. The paper feed roller 45 is driven by a pulse motor M4, while the paper guide roller 46 is not rotatable.

The surface of the paper guide roller 46 is coated and its hardness is 70. The gap mentioned above is set at about 0.3 mm which is selected by a certain margin to the paper thickness. By having such structures, even a thick recording paper 18 can be smoothly fed and no scratches are caused on the surface of the recording paper 18.

Adjacent to and on the upstream-side of the platen roller 25 provided are a grip roller 50 and a pinch roller 51 that abuts the grip roller 50. The upcoming recording paper 18 is fed into the gap between the rollers 50 and 51. The grip roller 50 is driven by a pulse motor M5. The pinch roller 51 rotates as it is driven by the recording paper being transferred.

On the downstream-side of the platen roller 25 are provided a first pair of discharge rollers 53 located on the side of the discharge opening 16 and a second pair of discharge rollers 54 located on the side of the platen roller 25 in order to discharge the recording paper 18 on the discharge tray 17. The discharge rollers 53 and the discharge rollers 54 are spaced across a certain distance and are driven by a pulse motor M6.

A guide 55 is provided between a platen roller 25 and the discharge rollers 54 to guide the transfer of the recording paper 18. A space 56 is formed underneath the guide 55 to store the recording paper 18 during printing.

In reproducing color images on the recording paper 18, the recording paper 18 is first supplied from the paper supply tray 14 and transferred to the direction indicated by an arrow P as shown in FIG. 4A the cyan image is printed on the recording paper 18 as it is transferred in the direction of arrow P. The recording paper 18 is stored in the space 56 as shown in FIG. 4B. Next, the yellow image is printed on the recording paper 18 while it is being transferred in a reverse direction indicated by an arrow Q. This process will be referred as a reverse printing process in this application.

After the yellow image has been copied using the reverse printing process, the recording paper 18 is transferred forward in preparation for the reproduction of the next image, or the magenta image. Thus, three color images, for example, are printed one on top of the other on the recording paper 18, to form a full-color image.

The thermal head 26 is pressed against the platen roller 25 only during the reverse transfer motion. In other words, the thermal head 26 is separated from the platen roller 25 when the recording paper 18 is being transferred forward. Also, the grip roller 50 and the pinch roller 51 are pinching the recording paper 18 all the time during the reverse and forward transfer motions repeated during the printing process.

A swivel guide 58 that swivels back and forth around its supporting shaft 57 is provided underneath the guide 55. The swivel guide 58 is used to guide the recording paper 18 received from the grip roller 50 and the pinch roller 51 either to the paper discharge section 22 where the discharge rollers 53 and 54 are provided or to the space 56. The swivel guide 58 is made of a flexible material.

The recording paper 18 will be stored in the space 56 when the swivel guide 58 is swiveled upward as shown in FIG. 4B. Incidentally, the recording paper 18 is transferred toward the paper discharge section 22 when the swivel guide 58 is swiveled in the clockwise direction around the support shaft 57 from its up position to its down position.

In order to improve the print quality, it is necessary to make the recording paper 18 not to be pinched between the discharge rollers 53 and the discharge rollers 54.

Also, by providing a swivel guide 58, the distance between the platen roller 25 and the discharge rollers 53, 54 can be reduced in forming the space 56 underneath the transfer route to the paper discharge section 22. This, in turn, reduces the installation space requirement of the recording apparatus 10.

The cutting section 23 for cutting the recording paper 18 is provided between the first pair of discharging rollers 53 and the second pair of discharging rollers 54. The cutting section 23 includes a rotary cutter 60 and a receiving table 61 that operates in coordination with the rotary cutter 60. Scraps of the recording paper, which consists of unprinted areas cut off by the cutting section 23, drop by their own weights to the reception unit 24 provided underneath of the cutting section 23 to be collected.

As shown in FIG. 1, the reception unit 24 and the discharge tray 17 are assembled together as one piece. As a result, when an operator collects the printed recording paper 18 from the discharge tray 17, the operator will automatically see the reception unit 24 located behind the discharge tray 17. And the operator will unconsciously confirm the condition of scrap paper piled in the reception unit 24.

The recording apparatus 10 is also equipped with a sensor S1 placed adjacent to the grip roller 50 to detect the leading edge of the recording paper during the paper supply process, or the trailing edge of the recording paper during the printing process. The sensor S1 issues an ON signal when it detects the leading or trailing edge of the recording paper 18. Since the sensor S1 detects the trailing edge during the printing process, it will be called, for the sake of convenience, the trailing edge sensor S1.

As shown in FIG. 2, the cutting section 23 has a leading edge sensor S2 to detect the leading edge of the recording paper. The leading edge sensor S2 issues an ON signal when it detects the leading edge of the recording paper 18. The pulses for driving the transfer motor M6 are controlled with the time when the leading edge sensor S2 detects the leading edge of the recording paper 18 as the reference point, and is used for the leading edge cut that cuts off a predetermined length of paper from the leading edge of the recording paper 18, or the trailing edge cut that cuts off a predetermined length of recording paper 18 from the trailing edge.

Also, a control unit 19 is provided in the low inside area of the recording apparatus 10 as shown in FIG. 2 and FIG. 3. The control unit 19 has a power source unit that supplies the outside power, a controller 90 such as a CPU and various circuit boards that receive signals via an interface from a control device (not shown) provided outside of the apparatus and controls various parts of the apparatus.

Figure 5:
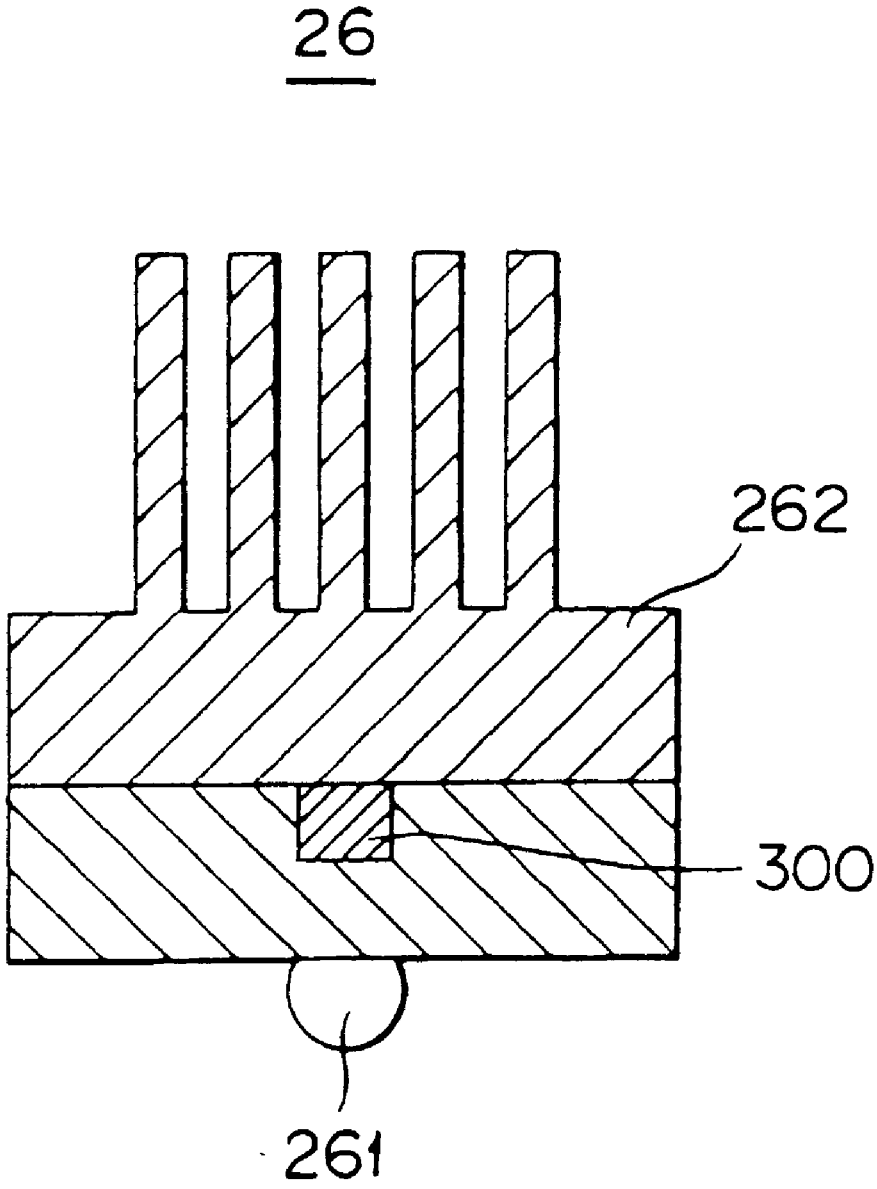
FIG. 5 is an enlarged cross sectional view of the thermal head of the recording apparatus.

FIG. 5 is an enlarged cross-sectional view of the thermal head 26 that heats the ink film. As shown in the figure, a thermistor (temperature detector) 300, is provided between a head element 261 and an upper heat sink 262.

Figure 6:
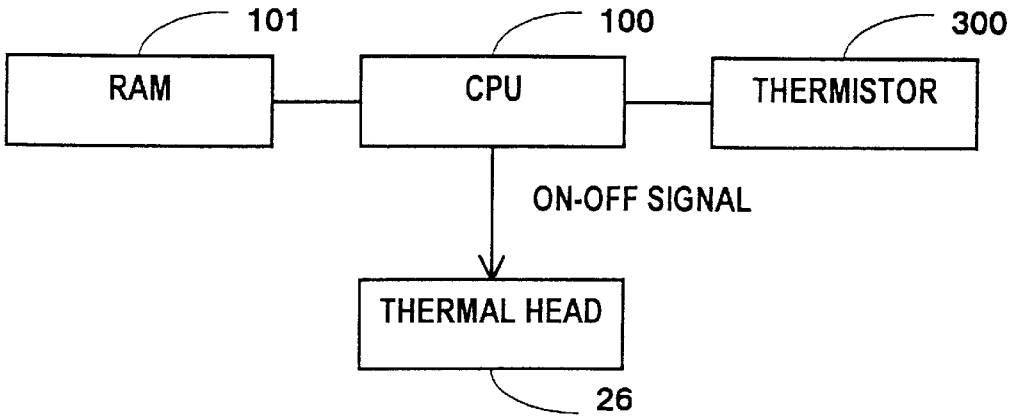
FIG. 6 is an outline block diagram of a preheating time decision circuit of the recording apparatus.

The recording apparatus 10 normally heats the thermal head before images are formed on the recording paper. FIG. 6 is an outline block diagram of a preheating time decision circuit of the recording apparatus. The preheating time decision circuit forms part of the controller 90.

A CPU 100, which decides the preheating time and controls the printing operation, receives, as an electrical signal, the voltage that corresponds to the thermal head temperature detected by the thermistor 300, and sends out on/off signals to a thermal head 26. The CPU 100 is connected to a RAM (memory device) 101 for storing a data table, which is used for deciding the preheating time.

Figure 7:
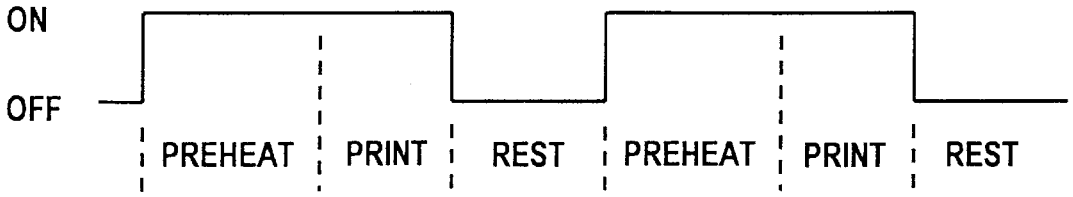
FIG. 7 is a time chart showing on/off operations of the thermal head while printing successively.

FIG. 7 is a time chart showing on/off operations of the thermal head while printing successively. As shown in the figure, successive printing on multiple sheets of recording paper is executed by repeating a cycle consisting of a preheat period wherein the thermal head is preheated prior to printing, a printing operation period, and a rest period provided in order to protect the thermal head by halting the electric power supply to the thermal head.

Figure 8A:
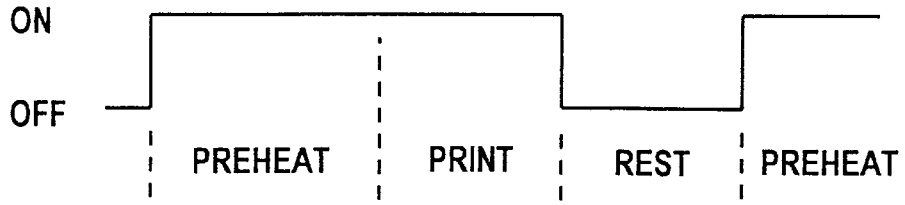
FIG. 8A through FIG. 8C are time charts showing on/off operations of the thermal head when the thermistor detection temperature is low, intermediate and high respectively.
Figure 8B:
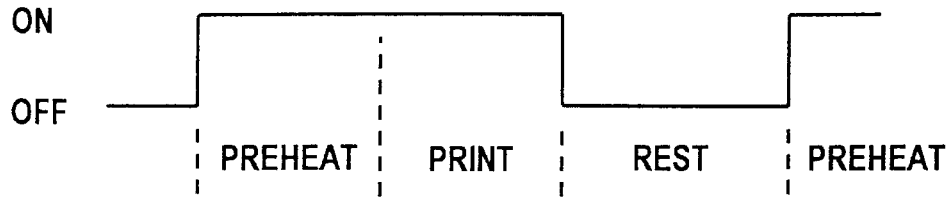
Figure 8C:
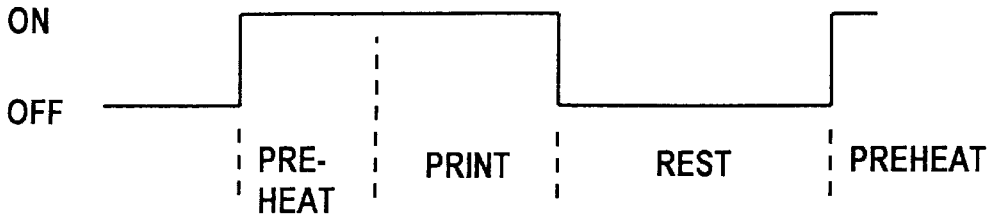

FIG. 8A through FIG. 8C are time charts showing on/off operations of the thermal head when the thermistor detection temperature is low, intermediate and high respectively.

When the thermistor detection temperature is low, for example, the preheating is conducted for approximately 2 milliseconds as shown in FIG. 8A, and the electric power is then supplied to the particular head element used for image forming to execute the printing operation. In case of the color print, an ink film of four colors is used. In other words, a color image is formed on a single sheet of recording paper by means of four printing operations. The density of images formed can be optimized, for example, by executing 2 milliseconds of preheating, 9 milliseconds of printing, and 12 milliseconds of rest. The preheating time when thermistor detection temperature is intermediate is shorter as shown in FIG. 8B compared to the time when the thermistor detection temperature is low as shown in FIG. 8A. Moreover, the preheating time is further shorter as shown in FIG. 8C compared to the time when the thermistor detection temperature is intermediate as shown in FIG. 8B.

When printing is to be started, for example, after a long period of rest extending more than one hour, the thermal head is cool and is at the room temperature. Therefore, if the preheating time is decided based on the thermistor detection temperature, the printing operation follows the time chart of the low temperature shown in FIG. 8A.

Figure 9A:
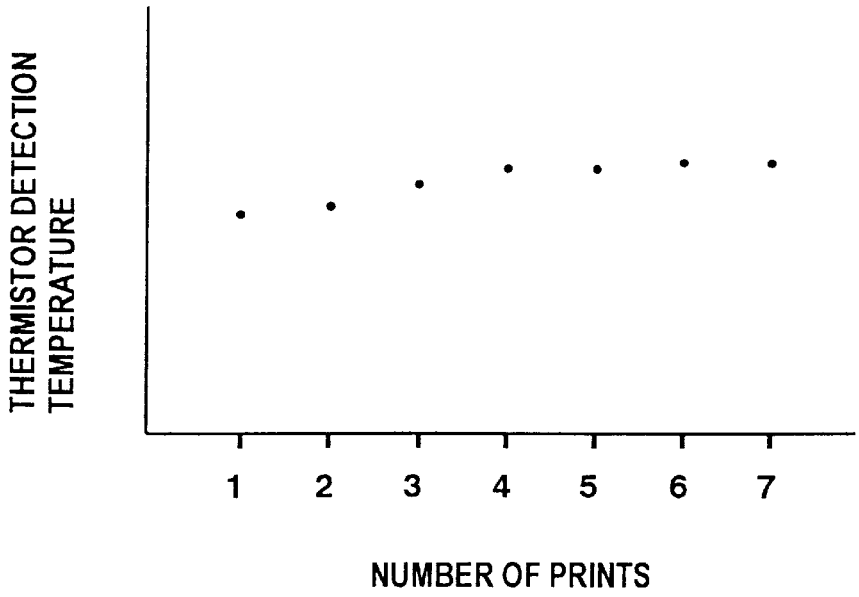
FIG. 9A is a diagram showing the relation between the number of prints and the thermistor detection temperature.
Figure 9B:
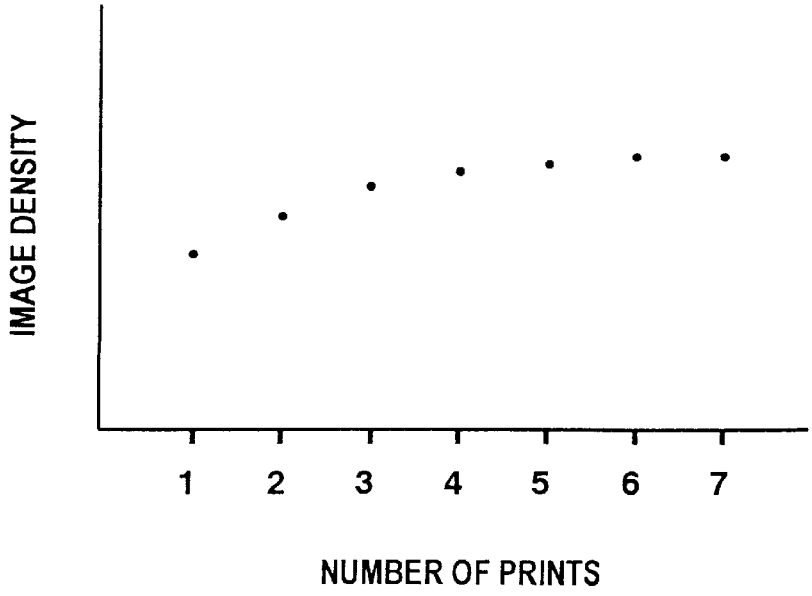
FIG. 9B is a diagram showing the relation between the number of prints and the image density.

The thermistor detection temperature does not rise immediately. Namely, the thermistor detection temperature for forming the images on the fourth sheet and thereafter is not much different from the thermistor detection temperature for forming the images on the first through third sheets of recording paper as shown in FIG. 9A. On the other hand, the density of the images formed on the recording paper changes substantially as the number of prints increases as shown in FIG. 9B. In other words, the density of the images formed on the first three sheets are weaker than the density of the half-tone images formed on the fourth sheet and thereafter.

The preheating time of the embodiment 1 is decided in consideration of the accumulated printing time, or the accumulated power supply time to the thermal head. The data table stored in the RAM 101, which is connected to the CPU 100 as shown in FIG. 6, is used for deciding the preheating time. The data table is prepared in correspondence with the accumulated power supply time, the thermistor detection time, and the preheating time. Therefore, the preheat timing decision can be easily done, which otherwise requires complex calculations.

Figures 10, 11:
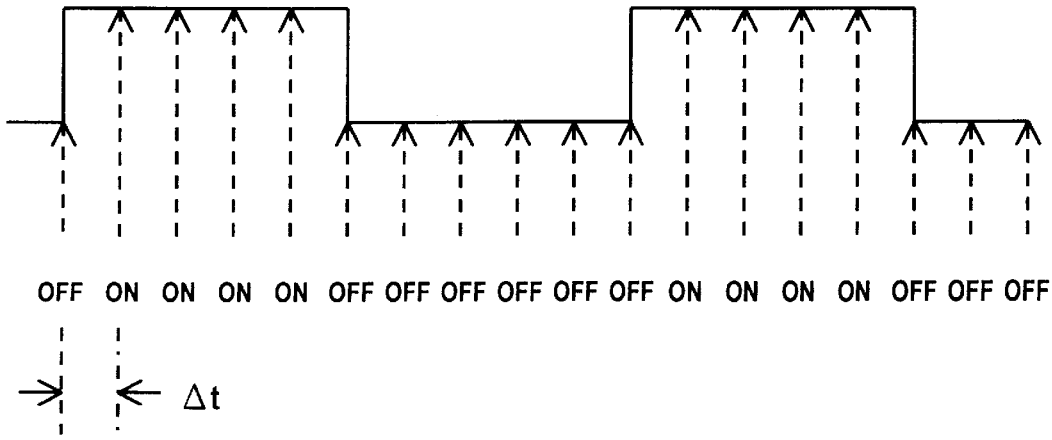
FIG. 10 is an example of the data table used for deciding the preheating time.
FIG. 11 is a diagram for describing the detection method of the on/off time of the thermal head.

FIG. 10 is an example of the data table used for deciding the preheating time. As shown in the figure, the preheating time $\tau$ ($\tau_{01}$ to $\tau_{mn}$) is decided from the thermistor detection temperature T ($T_1$ to $T_n$) and the accumulated power supply time t.

The accumulated electric power supply time t is obtained by detecting the on/off signals inputted into the thermal head at a constant interval $\Delta t$ as shown in FIG. 11 and counting the number of ON signals. The number of the ON signals inputted into the thermal head corresponds to the number of power supply cycles to the thermal head. The accumulated electric power supply time t is expressed as the product of the number of power supply cycles and the interval $\Delta t$.

If the interval $\Delta t$ is set to 1 millisecond and the on/off signal is to be detected for 30 minutes, it is necessary to store the detection result of $1.8\times10^6$ bits because 30 minutes are equal to $1.8\times10^6$ milliseconds. Therefore, if the detection result is stored intact, it requires a large memory capacity and is impractical.

In the embodiment 1, the detection result is divided into units of 2 bytes and the detected number of ON signals is stored. Since the 2 byte-based detection result corresponds to the data for 65535 times of the detection, it is also equivalent to the data for 65.535 seconds if the interval $\Delta t$ is 1 millisecond. The 2 byte-based detection results for 30 times correspond to the data for 32.77 (=65.535×30/60) minutes. Thus, the memory capacity required for storing the on/off signal for 30 minutes is about 60 bytes. Such a memory capacity can be provided easily by the internal memory of a conventional CPU.

The 2 byte-based on/off signal detection results for 30 times are always stored. In other words, whenever the latest detection result is stored, the oldest detection result is thrown out. As a result, the data for the latest 30 times of data, or for about 32 minutes, are stored.

The preheating time $\tau$ is decided by referring to the data table based on the thermistor detection temperature T and the accumulated power supply time t obtained as a product of the number of power supply cycles and the interval $\Delta t$.

Figures 12A, 12B, 12C, 12D:
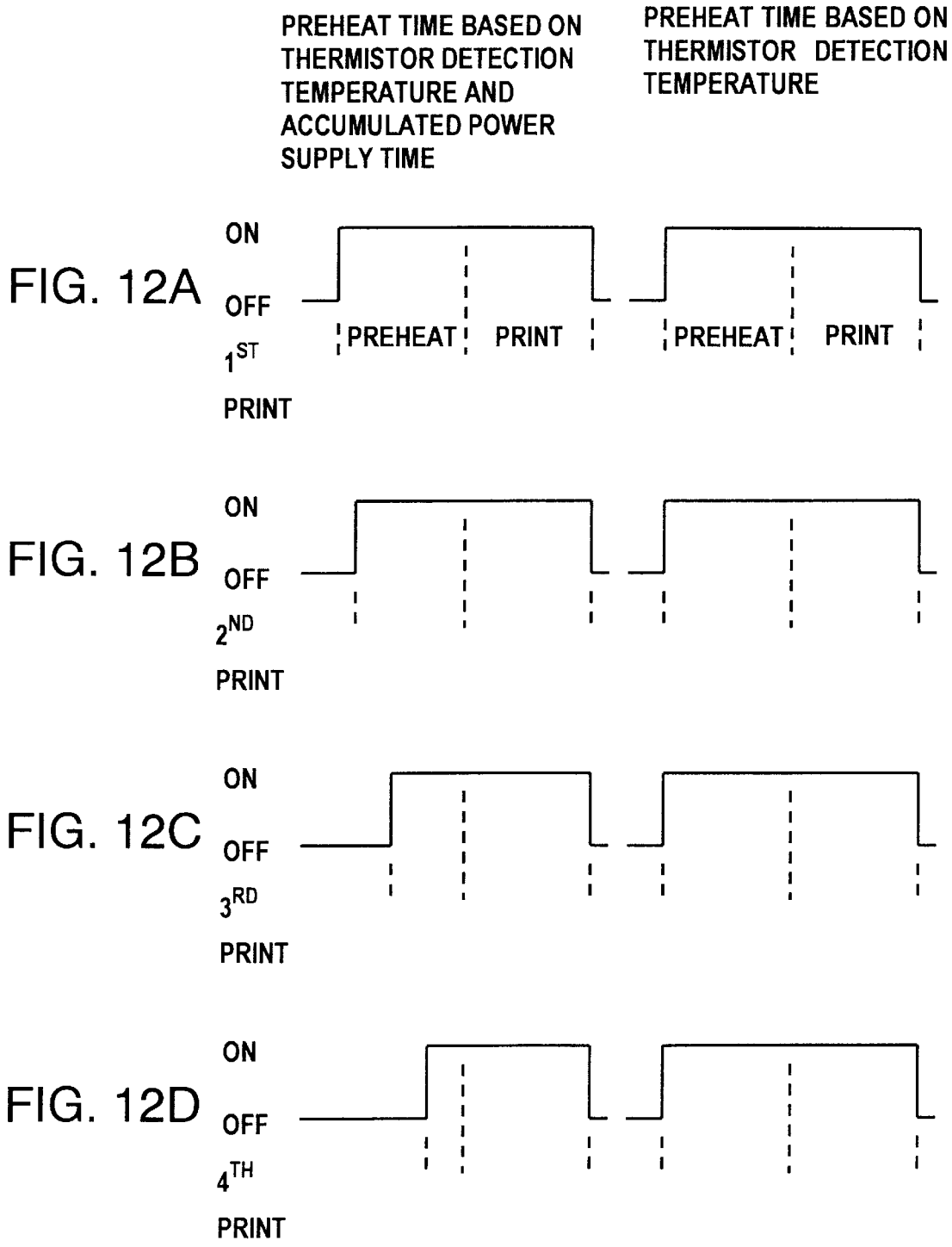
FIGS. 12A, 12B, 12C, and 12D are a diagram that show the relation between the number of prints and the preheating time.

FIG. 12 shows the relation between the number of prints and the preheating time decided based on the thermistor detection temperature and the accumulated power supply time. It also shows the preheating time decided based only on the thermistor detection temperature as a reference.

As shown in the figure, the preheating time decided considering the accumulated power supply time tends to shorten as the number of prints increase. On the other hand, the preheating time based only on the thermistor detection temperature changes very little.

As described above, the preheating time of the embodiment 1 is decided considering the thermistor detection temperature as well as the accumulated power supply time that corresponds to the effect of the heat accumulation on the thermal head. Therefore, the phenomenon of the print density of the first few sheets being weaker than the rest does not occur when a multiple sheets of recording paper are printed successively.

<Embodiment 2>

Figure 13:
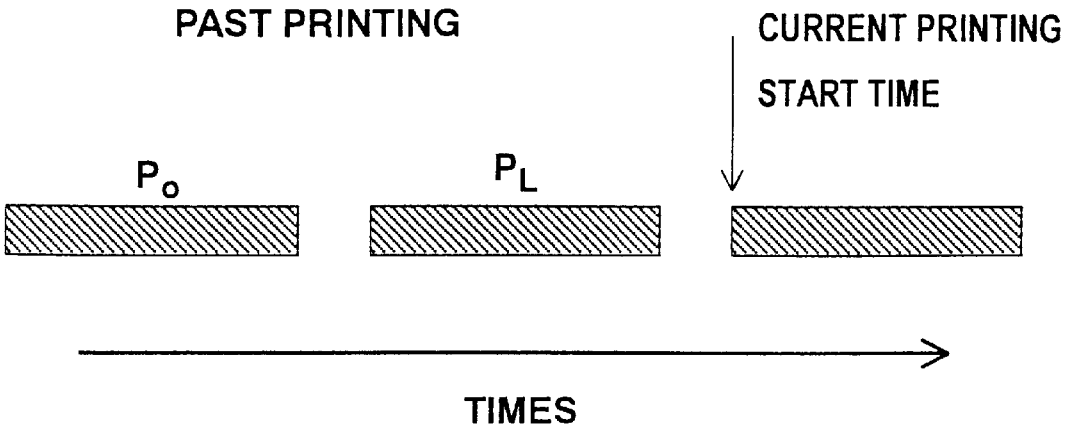
FIG. 13 is an explanatory diagram that relates to the second embodiment.

In the embodiment 1, the preheating time is decided using the accumulated time of supplying power to the thermal head from a certain point in time to the present within a fixed period of time. However, the heat accumulation of the thermal head is affected more by the power supplied closer to the actual printing time. As shown in FIG. 13, if there are two power supply periods $P_o$ and $P_L$ corresponding to the past printing, the power supply period $P_L$, which is closer to the actual printing time, contributes more to the current heat accumulation than the power supply period $P_o$, which is further back in the past.

The point of the embodiment 2 is that the preheating time is decided considering said difference of effects on the thermal head heat accumulation depending on how close those power supply periods are to the actual printing time. Since the basic structure of a heat transfer recording apparatus according to the embodiment 2 is the same as the embodiment 1, the description of the same is not repeated here and only the preheating time decision method will be described below.

While the 2 byte-based detection results of the on/off signals inputted into the thermal head for 30 times are stored in the embodiment 2 as well as in the embodiment 1, the detected results are weighted considering the degree of closeness in time to the printing time. Incidentally, the detection results are shown here as $m_1, m_2, \ldots m_{30}$, where the latest result is $m_{30}$ and the oldest result is $m_1$.

The detection results $m_1, m_2, \ldots m_{30}$ are related to the number of power supply cycles. Therefore, the weighted accumulated power supply time t' is expressed in the following formula (1):

$$t' = \sum_{i=1}^{30} a_i \times m_i \times \Delta t \quad (1)$$

where Δt is the detection interval, and the symbol i denotes a natural number of 1 through 30 representing the sequence number of detection results. The weight $a_i$ has a relation $a_i<a_2<, \ldots <a_{30}$. The embodiment 1 corresponds to a case where Δt=1 millisecond and $a_1=a_2=, \ldots =a_{30}=1$.

The preheating time is decided by referring to the data table shown in FIG. 10 based on the thermistor detection temperature and the accumulated power supply time weighted by considering the closeness in time to the printing time. Thus, the effect of the heat accumulated in the thermal head is more accurately considered in executing consecutive printing.

It is obvious that this invention is not limited to the particular embodiments shown and described above but may be variously changed and modified without departing from the technical concept of this invention. Further, the entire disclosure of Japanese Patent Application No. 09-216473 filed on Aug. 11, 1997, including the specification, claims, drawings and summary are incorporated herein by reference in its entirety.

What is claimed is:

1. A recording apparatus for forming an image on a recording paper by heating an ink film, the recording apparatus comprising a temperature detector that detects temperature of a heat source that heats ink films;

an accumulated time detector that detects accumulated time period during which electric power is supplied to the heat source within a prescribed period until up to image forming time; and a preheating time controller that decides a preheating time of the heat source based on a heat source temperature detected by said temperature detector and an accumulated power supply time detected by said accumulated time detector, the preheating time controller deciding the preheating time for each recording paper prior to the image forming on said recording paper.

2. A recording apparatus according to claim 1, wherein said preheating time controller comprises a memory that stores a data table, which is used to decide the preheating time based on the heat source temperature and the accumulated power supply time.

3. A recording apparatus according to claim 1, wherein said preheating time controller weights the accumulated power supply time based on closeness in time to image forming time of each power supply cycle.

4. A recording apparatus according to claim 1, wherein said temperature detector includes a thermistor.

5. A recording apparatus according to claim 1, wherein said apparatus is a printer which prints images recorded on photographic films.

6. A recording apparatus according to claim 1, wherein said apparatus is a printer which prints images formed by and transferred from a computer.

7. A recording apparatus for forming an image on a recording paper by heating an ink film, said recording apparatus comprising:

a heat source;

a heat source controller which controls said heat source so as to generate heat for a prescribed time prior to printing for each recording paper and to generate heat during printing; and a time controller which decides said prescribed time based on a temperature of said heat source and sum of time period during which said heat source generates heat.

8. A recording apparatus according to claim 7, wherein said sum of time period is decided by accumulating time during which said heat source is energized.

9. A recording apparatus according to claim 7, wherein said time controller comprises a memory which stores a data table showing a relationship between the temperature of said heat source and the sum of time period.

10. A recording apparatus according to claim 7, wherein said time controller decides the sum of time period based on each time period and the number of times during which said heat source generates heat.

11. A recording apparatus according to claim 10, wherein said time controller weights the each time period upon summing up the each time period.

12. A recording apparatus according to claim 7, wherein said apparatus is a printer which prints images recorded on photographic films.

13. A recording apparatus according to claim 7, wherein said apparatus is a printer which prints images formed by and transferred from a computer.

14. A recording apparatus for forming an image on a plurality of sequential recording papers by heating an ink film, the recording apparatus comprising:

a thermal head having a heat source that heats ink films, the thermal head moveable from a first position to a second position, the thermal head in the first position in contact with a recording paper and in the second position out of contact with the recording paper, a temperature detector that detects the temperature of the heat source;

an accumulated time detector that detects accumulated time period during which electric power is supplied to the heat source within a prescribed period until up to image forming time for each of said plurality of recording papers; and a preheating time controller that decides a preheating time of the heat source based on the heat source temperature detected by said temperature detector and an accumulated power supply time detected by said accumulated time detector, the preheating time controller deciding the preheating time for each recording paper prior to image forming, the preheating time varying for the preheat period up until image forming time on each of said plurality of recording papers to provide uniform print density to each of said plurality of recording papers, said preheating time occurring while the thermal head is in the second position.

15. A recording apparatus according to claim 14, wherein said preheating time controller comprises a memory that stores a data table, which is used to decide the preheating time based on the heat source temperature and the accumulated power supply time.

16. A recording apparatus according to claim 14, wherein said preheating time controller weighs the accumulated power supply time based on closeness in time to image forming time of each power supply cycle.

17. The recording apparatus according to claim 14, wherein said temperature detector includes a thermistor.

18. A recording apparatus according to claim 14, wherein said apparatus is a printer which prints images recorded on photographic films.

19. A recording apparatus according to claim 14, wherein said apparatus is a printer which prints images formed by and transferred from a computer.

* * * * *